United States Patent [19]

Blossey et al.

[11] 4,181,426

[45] Jan. 1, 1980

[54] RANDOM-DUMP STORAGE BUFFER FOR MOVING WEB

[75] Inventors: Daniel F. Blossey, Rochester; Narayan V. Deshpande, Penfield; Eugene C. Faucz, Webster, all of N.Y.

[73] Assignee: Xerox Corporation, Stamford, Conn.

[21] Appl. No.: 934,573

[22] Filed: Aug. 17, 1978

Related U.S. Application Data

[63] Continuation of Ser. No. 782,122, Mar. 28, 1977, abandoned.

[51] Int. Cl.[2] ..... G03G 15/00; G03G 19/00; B65H 17/50

[52] U.S. Cl. ..... 355/16; 226/97; 226/118; 346/74.1; 360/132

[58] Field of Search ..... 226/97, 118, 119; 355/16, 3 BE; 346/74.1; 360/71, 132; 242/182, 183, 184, 185; 271/97, 195

[56] References Cited

U.S. PATENT DOCUMENTS

| | | | |
|---|---|---|---|
| 3,065,892 | 11/1962 | Castelijns | 226/97 |
| 3,417,484 | 12/1968 | McCarthy | 226/97 X |
| 3,499,589 | 3/1970 | Johnson et al. | 226/97 |
| 3,528,593 | 9/1970 | Armstrong et al. | 226/97 |
| 3,998,542 | 12/1976 | Toto et al. | 226/119 X |
| 4,000,516 | 12/1976 | Watanabe et al. | 242/184 X |

*Primary Examiner*—Bruce H. Stoner, Jr.
*Attorney, Agent, or Firm*—Michael H. Shanahan

[57] ABSTRACT

A storage buffer for a moving web comprises a collection bin having a bottom triangular cavity, a top opening through which the web can be randomly dumped under the influence of gravity and a bottom opening through which the web is withdrawn from the collection bin on a first-in, first-out basis. The sloping bottom walls of the collection bin are provided with ridges to assure the maintenance of a gas bearing beneath the bottom-most layer of exiting web. Nozzles for directing pressurized gas into the collection bin are located on both sides of the web at the collection bin exit.

1 Claim, 3 Drawing Figures

RANDOM-DUMP STORAGE BUFFER FOR MOVING WEB

This is a continuation, of application Ser. No. 782,122, filed Mar. 28, 1977, now abandoned.

BACKGROUND OF THE INVENTION

This invention relates to the handling of webs of material; and more particularly, to devices within which moving webs are temporarily collected and stored during their path of travel.

In many web handling systems, it is often desirable to have a length of web greater than the travel path of the web. For example, in imaging systems, it is often desirable to have a short travel path for a web of imaging material upon which a latent image is created. This short travel path is often times desirable in order to achieve compactness of machine design. However, at the same time, it is often times desirable to have a long web of imaging material so that optional, convenience functions can be performed by the machine. For example, in imaging systems utilizing a web of imaging material, an original document to be copied can be pre-collated with a long web of imaging material by sequentially imaging each of the original pages onto the long web of imaging material prior to printing copies of the original document. This is particularly desirable in high speed printing systems wherein a master is latently recorded on the web of material at one station and subsequently transferred to a printing engine which runs the web of imaging material at high speeds through developer stations where graphic marking material is used to develop the latent image on the master and then through a transfer station where the graphic marking material is transferred from the master to a receiving member, such as paper, whereby copies are made.

In other industries, such as Textiles and Plastics, long webs of material are typically processed through a process travel path which is shorter than the length of the web of material.

One solution for providing temporary collection and storage of a web of material is a storage bin such as that shown in Figure 15.4 of "Magnetic Materials and Their Applications" by Ink C. Heck, published by Crane Russak and Company, New York, 1974. The device shown therein is a simple box like structure used in the tape-loop recorder of Bell Telephone Manufacturing Company, Ltd. A magnetic tape much greater in length than the travel path through the recorder is temporarily stored and collected, during recording, in the box-like structure. The recorded tape is allowed to randomly fall through the top opening of the box and tape to be recorded is pulled out of the same top opening of the box. By drawing tape from the same opening in the top, the behavior of the temporarily collected and stored web of magnetic tape undergoes undesirable activity. For example, the randomly dumped tape undergoes a "first in" - "first out" movement which assures that the bottom most fold of web is pulled up through the other layers of web fold creating a tumbling and mixing action of the temporarily collected and stored tape. One disadvantage of this tumbling and mixing action is that the collection bin must be made sufficiently large to accommodate the increased space occupied by the tumbling and mixing of the tape. Another disadvantage is the possibility of creasing and damaging the tape by this mixing and tumbling action.

Storage buffers utilizing compressed air in addition to mechanical aids for collecting moving web are shown in U.S. Pat. Nos. 3,528,593 and 2,808,259. Both the tape entry and exit is from the top of the storage buffer and mechanical aids are used to avoid tumbling and mixing of the tape as it is withdrawn from the top.

U.S. Pat. Nos. 3,514,024 discloses the use of forced air on each side of the bottom most layer of web and to separate the lower most layer of web from the next higher layer of web in a collection bin. However, an end wall segment is utilized for supporting the moving web.

The existing moving web storage devices, while providing their intended result, are relatively mechanically cumbersome due to the design requirements necessary to insure low friction. An elegant solution utilizing a relatively compact storage buffer is provided by the present invention.

The present invention provides a compact moving web storage buffer with assured maintenance of gas or air bearings, allowing relatively low velocity gas or air flow to be utilized.

SUMMARY OF THE INVENTION

It is, therefore, an object of the invention to overcome the above noted deficiencies.

It is another object of this invention to provide a novel storage buffer for a moving web.

It is a further object of this invention to impart precollation capability to imaging systems utilizing a moving web of length greater than the travel path of the web through the system.

The foregoing objects and other are accomplished in accordance with the practice of the present invention by a funnel shaped storage buffer for a moving web, comprising a collection bin having an opening through which said web can be randomly dumped under the influence of gravity and a bottom opening through which the web is withdrawn; the bottom walls, which are sloped downwardly, are provided with ridges to provide frictionless flow of the web through the exit without intermittent interruption.

BRIEF DESCRIPTION OF THE DRAWINGS

For a better understanding of the invention as well as other objects and further features thereof, reference is made to the following detailed disclosure of the preferred embodiments of the invention taken in conjunction with the accompanying drawings thereof, wherein.

DESCRIPTION OF THE PREFERRED EMBODIMENTS

Figure 1:
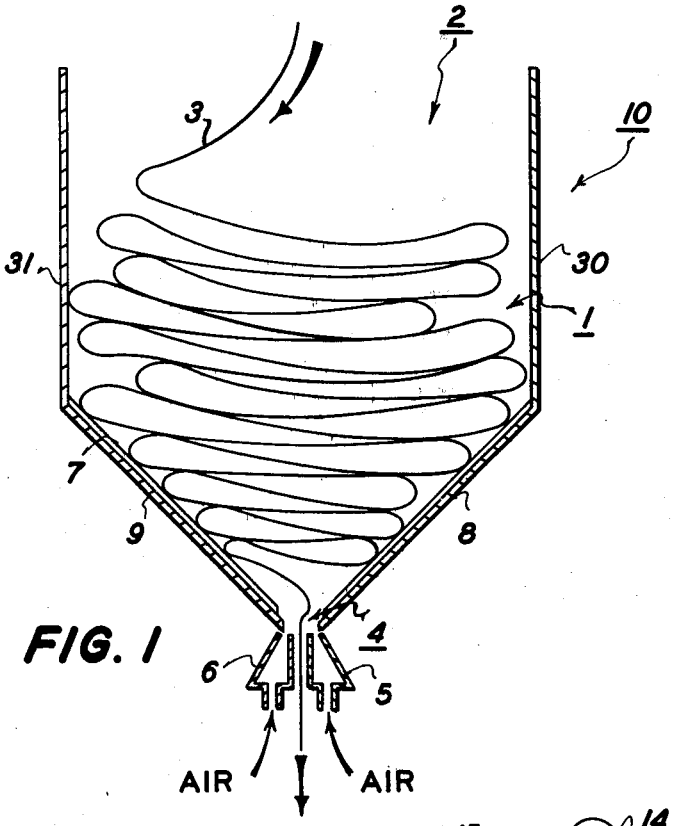
FIG. 1 is a schematic illustration of an embodiment of the storage buffer of the present invention.

Referring now to FIG. 1, the storage buffer for a moving web is generally designated 10 comprising a collection bin 1 having an opening 2 through which a moving web 3 is randomly dumped under the influence of gravity and an opening 4 through which the web is withdrawn. The storage buffer is provided with means 5 and 6 for floating the randomly dumped web 3 within the collection bin 1 upon a cushion of gas.

the lower portion of the storage buffer comprises slopong walls 8 and 9 so as to define a three-dimensional triangular cavity 5 between bottom opening 4 and vertical walls 30 and 31. Gas nozzles 5 and 6 are provided one at each side of bottom opening 4 to direct pressurized gas or air into the triangular cavity.

Moving web 3 exits the collection bin through bottom opening 4 and is maintained away from walls 8 and 9 at opening 4 by the air streams coming from nozzles 5 and 6.

The flow of pressurized gas or air through nozzles 5 and 6 is adjusted so that the pressurized gas passing into the triangular cavity is sufficient to maintainan air bearing between randomly dumped moving web 3 contained in the triangular cavity and sidewalls 8 and 9. Most significantly, it has been found that when such a sufficient air bearing pressure is used with flat, unmodified walls 8 and 9, intermittent interruption of frictionless flow of web 3 occurs. Web 3 is intermittently slapped down into contact with walls 8 and 9 and refuses to be drawn out of opening 4 until sufficient tension on web 3 overcomes its resistance. This results in a jerky, dynamic loading of web 3 which can be so severe as to stretch web 3 and render it unusable for its intended purpose. The cause of this problem is believed to be due to a pressure differential existing between the fast moving air between side walls 8 and 9 and the portions of web 3 adjacent thereto and the air within the folds of web 3 within the triangular cavity. This problem is overcome by providing ridges 7 to walls 8 and 9. Surprisingly, very thin ridges of about 5 mils are adequate to maintain the air bearing without intermittent interruptions. Thicker ridges can be employed. The ridges can be provided by using adhesive tape, by conforming the walls 8 and 9 during manufacture, by adhering shimstock to walls 8 and 9, and by other ridge forming methods.

When moving web 3 is commercially available magnetic tape of about 4 inches in width and about 1.5 mil thick, a typical range of pressure for pressurized gas through nozzles 5 and 6 is from about 1 to about 4 inches of water. This range of pressure is sufficient to maintain the air bearing and to separate the layer of web passing through web exit 8 from the next, higher layer of web. Higher pressures can be employed satisfactorily in the practice of the present invention. Generally speaking, pressures greater than those required to accomplish the functions of air bearing formation and separation for any given length and thickness of magnetic tape, generally requires a larger collection bin due to the tendency of the magnetic tape to become fluffed by the pressurized gas. With 200 feet of web of commercially available 1.5 mil thick magnetic tape, and with pressurized air at about 3 inches of water pressure into nozzles 5 and 6, the force required to pull moving web 3 through web exit 4 is less than 100 grams.

Figure 2:
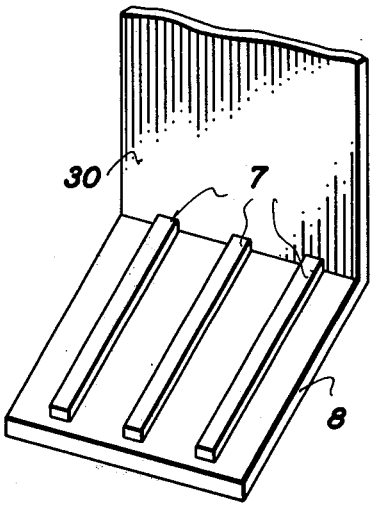
FIG. 2 is a schematic illustration of sloping bottom wall of the storage buffer showing the ridges which prevent intermittent interruption of frictionless web flow.

The modification of adding ridges 7 to walls 8 and 9 is shown in FIG. 2. It will be appreciated that web exit 4 and nozzles 5 and 6 are of substantially the same width in the preferred embodiment of the invention; however, nozzles 5 and 6 may be of any shape and width effective to perform the functions of separating the layer of web exiting through web exit 4 from the next, higher layer of web material and of air bearing formation between walls 8 and 9 and the web portions adjacent thereto. The air bearing is also formed between ridges 7 and the web portions thereto adjacent.

Numerous advantages are provided by the storage buffer of the present invention. The pressurized gas or air bearing between the collected moving web and walls 8 and 9 in the triangular cavity allows for drawing the web from the bottom of the collection bin without friction. Drawing from the bottom of the collection bin removes the tumbling and mixing action involved when pulling randomly dumped and collected tape up through the other layers from the top of the collection bin. This bottom draw eliminates the possible creasing or damaging of the tape due to the tumbling action especially at the higher tape speeds. Bottom draw through the triangular cavity also allows for a smaller physical size. No allowance in size of the collection bin is necessary for the tumbling or mixing action associated with top draw. Nozzles 5 and 6 at the web exit 4 keeps the tape loops separated near exit 4 and provides a cushion of air over the exiting tape in addition to the air bearing at walls 8 and 9. The combination of these effects provide a very smooth, almost frictionless, tape storage buffer capable of very high speeds. The effect of tape width and weight is virtuallyeliminated.

Figure 3:
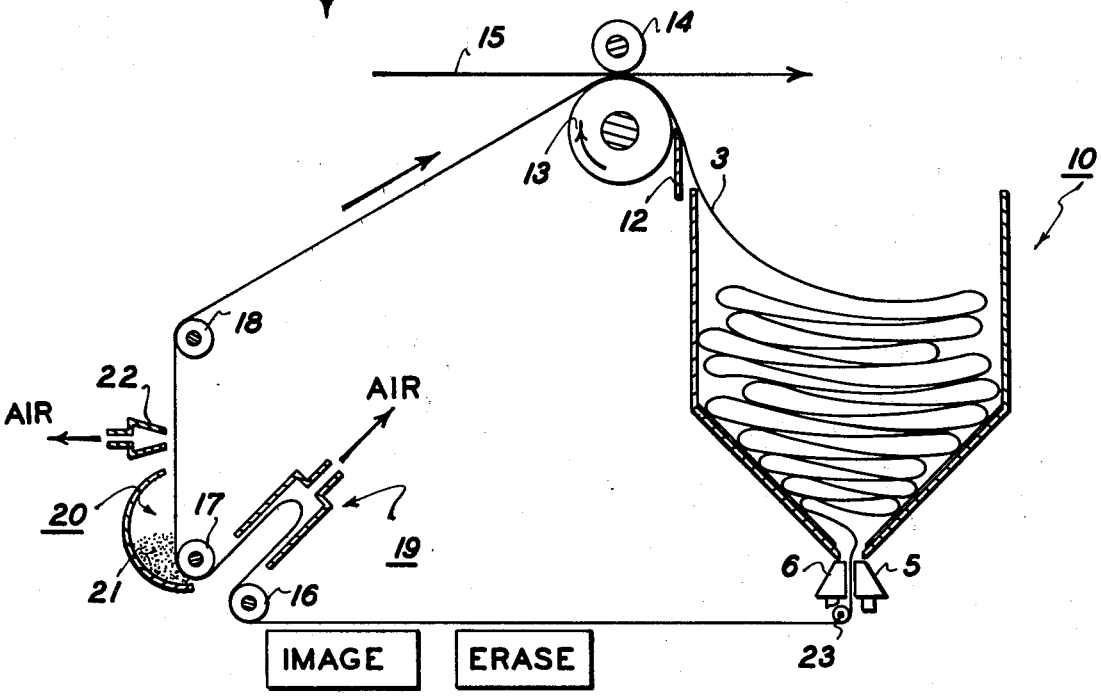
FIG. 3 is a schematic illustration of a magnetic imaging system utilizing the storage buffer of the present invention.

Referring now to FIG. 3, there is seen a schematic illustration of a magnetic imaging system utilizing the storage buffer of the present invention. Therein is shown a magnetic print engine which with the addition of the optional erase and image stations indicated within the boxes can optionally form a complete magnetic imaging system. In FIG. 3, like numerals refer to like components described in conjunction with FIGS. 1 and 2. With respect to the complete print engine only, a previously imaged web 3 of magnetic tape is taken from a recording or imaging engine to the print engine shown in FIG. 3 and inserted along its travel path with the excess length of web 3 placed in collection bin 1 of storage buffer 10. As shown in FIG. 3, transfer rollers 13 and 14 engage web 3 of magnetic tape and receiving member 15 (such as paper, etc.) and sandwiches them in the nip formed between rollers 13 and 14. Web 3 is therefore driven at the location of the pressure nip between transfer rollers 13 and 14. To avoid tracking problems, tension means 19 is provided so that the resulting tension created in web 3 allows web 3 to track through the pressure nip. Rollers 17, 18 and 23 are idler rollers. Tension means 19 can comprise any conventional tension means and is illustrated in FIG. 3 as a vacuum column. The use of a vacuum column is preferred because it has shown to be an excellent edge guide for web 3 in addition to its function as a tensioning device. A relatively small tension from about 0.15 pounds per inch to about 0.5 pounds per inch of tape width gives satisfactory results. Nip loading appears to have no effect on the tape tension; however, in addition to the tension, the wrap angle of web 3 prior to the nip should be carefully adjusted to obtain good operation. A wrap angle from about 90 degrees to about 120 degrees provides good operation. It has also been found that in printing systems where the web 3 of magnetic tape is not to be driven by a pressure nip, for example, such as when the tape was edge driven at a roller downstream of the transfer station, there was neglible tension in the tape and no tape tracking problems were experienced in handling the tape at speeds as high as 70 inches per second with vacuum means 19 omitted. Higher speeds were not utilized due to the speed limitations of the motor employed. However, it is expected that the storage buffer of the present invention will exhibit no tape tracking problems in edge driven embodiments when higher speeds are utilized.

Web 3 of magnetic tape is pulled through web exit 4, tensioned by tensioning means 19 such as the vacuum column shown, passed through the developer station 20 wherein latent magnetic images on web 3 are developed by magnetic toner 21, passed by vacuum nozzle 22 which removes excessive magnetic toner from background portions of the latent magnetic image on web 3, and passes through the pressure nip of transfer rollers 13 and 14 whereby magnetic toner material 21 residing on web 3 of magnetic tape is pressure transferred onto paper 15 to form a visible image thereon corresponding to the latent magnetic image on web 3.

To provide a complete imaging system, the addition of an erase station and an imaging station to the print engine of FIG. 3 is made. The various stations, including the optional erase and image station shown in FIG. 3 are known in the art. These conventional stations can be employed. Furthermore, storage buffer 10 can be inserted in either the magnetic print engine or the magnetic imaging system anywhere along the path of travel of web 3 of magnetic tape and inbetween any two stations. However, for machine cleanliness and convenience of web handling, it is preferred to have storage buffer 10 located along the path of travel of web 3 at a location where web 3 is substantially free of magnetic toner. The order of stations, including the optional erase and image stations, noted in FIG. 3 constitutes the typical order of stations in a complete magnetic imaging system in which the latently imaged member is continuously recycled through its travel path. Thus, creation of the latent image at the image station occurs prior to development, development occurs prior to transfer of the visible image to a receiving member, and transfer of the visible image to a receiving member occurs prior to erasure of the latent image on web 3, and erasure of the latent image on web 3 occurs prior to creating another latent image on web 3. It is preferred in these embodiments having an imaging and erase station to locate vacuum tensioning means 19 intermediate the erase station and storage buffer 10, roller 23 being dispensed with, to having a tensioned web at the image and erase stations.

As previously mentioned, the stations shown in FIG. 3, including the optional erase and image stations, are conventional in the art. These stations are found in U.S. Pat. Nos. 3,555,556 and 3,555,557 (thermomagnetic recording); 3,787,877 (improved magnetic recording member, erase station, development station, cleanup station, and transfer station). In addition to thermomagnetic recording, direct magnetic recording such as that shown in U.S. Pat. No. 3,161,544 or U.S. Pat. No. 3,253,626 can be employed. All of the aforementioned patents are hereby expressly incorporated by reference.

It will be appreciated that other variations and modifications will occur to those skilled in the art upon a reading of the present disclosure. These are intended to be within the scope of this invention. For example, in imaging systems utilizing a web greater in length than its path of travel and where, owing to the imaging system employed, such as, for example, the chemical sensitivity of the web to any particular environment, it may be desired to utilize a pressurized gas which is inert with respect to the chemical sensitivitiy of the web. Accordingly, the phrase "gas" is used herein to refer to all materials in the state of matter commonly referred to as the gaseous state. In most applications for the storage buffer of the present invention, pressurized air can be employed. However, the term pressurized "gas" is employed herein to indicate the scope of applicability of the present invention to all web handling systems.

What is claimed is:

1. Magnetic imaging apparatus for printing collated sets of copies comprising a continuous magnetic recording web having a length and width of at least 4 inches to accomodate a plurality of latent magnetic images of original documents comprising a set in collated order aligned along the length of the web, development means for developing the latent magnetic images on the web while the web is moving by depositing a magnetic marking material on the web in the areas corresponding to the latent magnetic images making them visible, transfer means for transferring the marking material from the web while moving to a copy support member to produce the copies of a collated set and web transport means for repeatedly moving the web along a closed loop path past the development and transfer means for the serial production of collated sets of copies each revolution of the web about the loop, the length of the loop path being significantly shorter than the length of the web, said transport means including web buffer means including a collection bin having vertical side walls and sloped bottom walls defining a web storage cavity including a triangular shaped cavity formed by the sloped bottom walls, the sloped walls being spaced apart near the apex of the triangular cavity defining an exit orifice for the web and blower means for directing pressurized gas into said exit orifice at opposite sides of a web exiting the bin, said collection bin having an entrance orifice at the top defined by the vertical side walls located along the closed loop web path to receive the web during a generally downward movement of the web enabling the web to collect in folds between the vertical side walls and the bottom sloped walls, said sloped bottom walls including ridges to space the folded web from the sloped walls and to promote a gas bearing between the web folds and the sloped walls created by the pressurized gas directed into the bin by the blower means to lower the resistance to movement of the web along the loop path whereby the effects of web width and weight are substantially eliminated yielding smooth almost frictionless movement of the tape from the storage bin.

* * * * *